US005669604A

United States Patent [19]

Hansen

[11] Patent Number: 5,669,604

[45] Date of Patent: Sep. 23, 1997

[54] SYSTEM FOR ACCELERATING AND TRANSFERRING IMBRICATED PRINTED PRODUCTS TO A GRIPPING CHAIN

[75] Inventor: Erik Hansen, Horsens, Denmark

[73] Assignee: Thorsted Maskiner A/S, Horsens, Denmark

[21] Appl. No.: 596,098

[22] PCT Filed: Aug. 3, 1994

[86] PCT No.: PCT/DK94/00298

§ 371 Date: Feb. 5, 1996

§ 102(e) Date: Feb. 5, 1996

[87] PCT Pub. No.: WO95/03989

PCT Pub. Date: Feb. 9, 1995

[30] Foreign Application Priority Data

Aug. 3, 1993 [DK] Denmark ..... 0899/93

[51] Int. Cl.[6] ..... B65H 7/02; B65H 29/66

[52] U.S. Cl. ..... 271/265.01; 271/270; 271/277; 271/202; 271/204

[58] Field of Search ..... 271/198–200, 271/202–204, 270, 274, 184, 265.01, 275, 277

[56] References Cited

U.S. PATENT DOCUMENTS

| | | | |
|---|---|---|---|
| 4,201,286 | 5/1980 | Meier | 271/202 X |
| 4,241,910 | 12/1980 | Matsuo | 271/202 |
| 4,320,894 | 3/1982 | Reist et al. | 271/204 |
| 4,333,559 | 6/1982 | Reist | 271/202 X |
| 4,550,822 | 11/1985 | Meier | 271/202 X |
| 4,566,687 | 1/1986 | Faltin | 271/202 |
| 4,905,981 | 3/1990 | Reist | 271/202 X |

FOREIGN PATENT DOCUMENTS

| | | | |
|---|---|---|---|
| 850989 | 7/1952 | Germany | 271/198 |
| 101548 | 8/1980 | Japan | 271/200 |
| 236718 | 7/1925 | United Kingdom | 271/204 |
| 13566 | 6/1994 | WIPO | 271/184 |

*Primary Examiner*—Boris Milef

*Attorney, Agent, or Firm*—Antonelli, Terry, Stout & Kraus, LLP.

[57] ABSTRACT

A system for conveying flat products, such as folded newspapers. The products are received in imbricated formation on a first conveyor and passed to an intermediate or transfer conveyor, the receiving and of which is at a lower level than the discharge end of the first conveyor. The transfer conveyor accelerates the products to a conveyor which has gripping members that receive the leading edges of the products and which moves at a slower speed than the transfer conveyor. The acceleration of the products on the transfer conveyor assures that the leading edges are received within the gripping members.

5 Claims, 1 Drawing Sheet

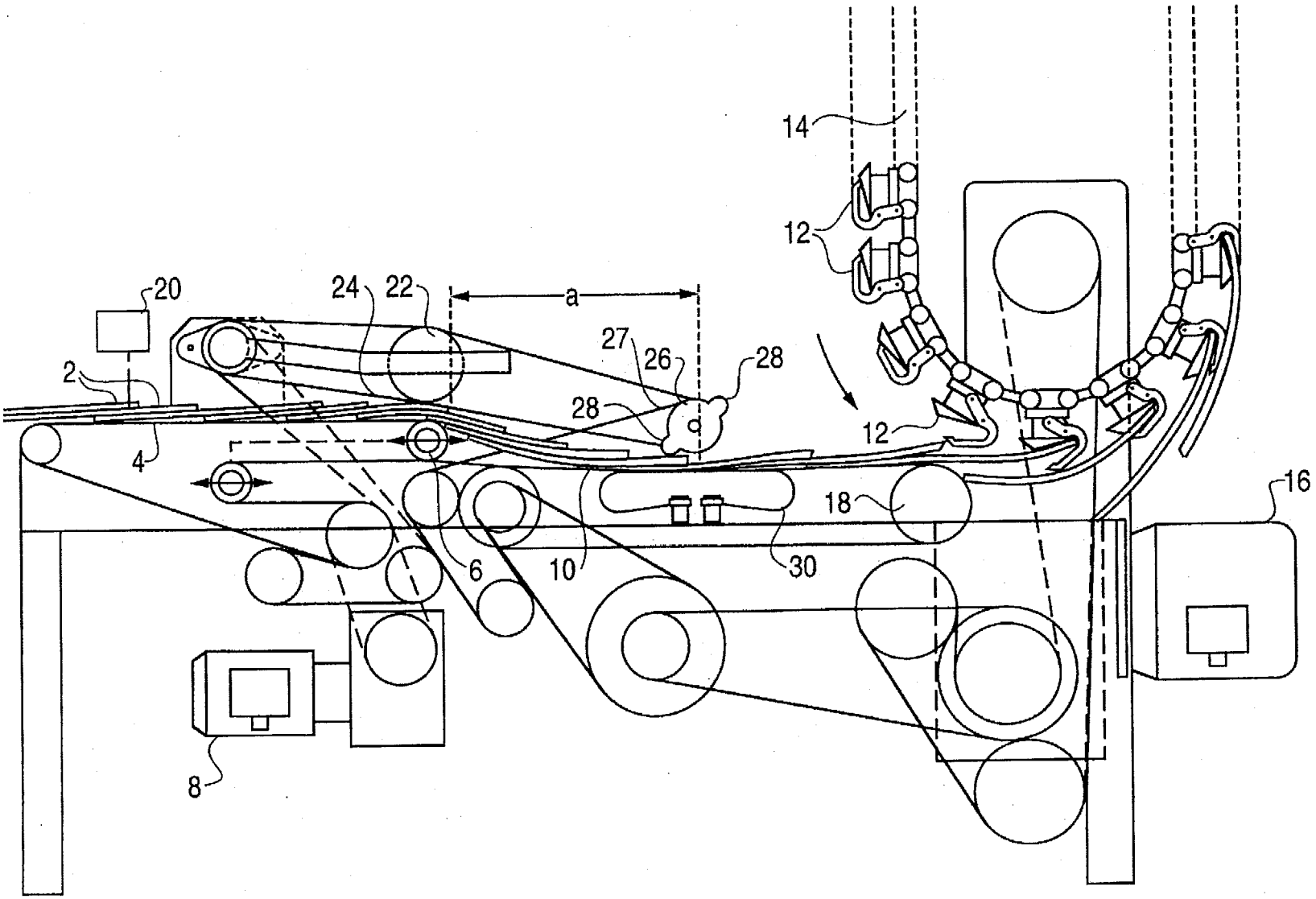
16
14
12
12
18
30
28
26
27
28
a
10
6
22
24
20
4
2
8

SYSTEM FOR ACCELERATING AND TRANSFERRING IMBRICATED PRINTED PRODUCTS TO A GRIPPING CHAIN

BACKGROUND OF THE INVENTION

The present invention relates to a system for delivering printhouse products, in particular folded newspapers, from moving flow of the products in imbricated formation to gripping means in connection with a chain conveyor. Mainly in the production of newspapers on rotary presses it is customary that the papers are delivered in imbricated formation on a conveyor belt, but at a later stage of the flow it may be desirable that the flow is guided both upwardly and downwardly, whereby it is usual to let the product be transferred to conveying means that positively hold the single products, this suitably being done by means of a chainlike gripping conveyor. This latter should then be equipped with suitably interspaced grippers that can be actuated for gripping the products advanced on the conveyor belt.

The product flow appears with a relatively high velocity, and in practice it has been found that it is very difficult to arrange for the relevant transfer in a fully safe manner. For natural reasons it is highly disturbing if the transfer gets out of order, as the rotary press can only be stopped by extreme emergencies once the production has started.

SUMMARY OF THE INVENTION

Generally, according to the invention, a transfer with increased safety is obtainable when where is arranged, immediately before the place of transfer, an acceleration of the products advanced on the conveyor belt, such that these products can be brought to be actively projected into the further conveying gripping means of the gripping chain system. These grippers, for natural reasons, should be advanced in synchronism with the products on the first conveyor, but in successively either raising the delivery speed of the products or periodically lowering the receiver velocity of the gripping means it will be achievable for the leading edges of the advanced products to be brought into a safe engagement with the gripping means of the succeeding gripping conveyor.

It is quite important, however, that the products are accelerated in a uniform manner. From the rotary press they are delivered with a non-uniform precision in the imbrication pattern, and care must be taken that after the acceleration they are delivered to the gripping chain in an at least almost uniform manner. It has been found that the products in the imbricated formation, when transferred from the first conveyor directly to the faster conveyor, may become mutually spaced in an irregular manner in the accelerated row of products, and for the invention it is important to indicate how this problem can be overcome. It will be possible to use one or more of the following measures:

1) In the transfer area, use is made of an overlying pressure belt at the delivery end of the supplying conveyor belt, such that the products are not released for any relative displacement until after their rear ends having left this area, i.e. from a location where a certain displacement force may already have been applied to the products. In case of minor differences the products might otherwise be projected into mutually different positions, and this will be counteracted by the measure mentioned here.

2) The receiving acceleration conveyor is mounted at a level somewhat lower than the feeding conveyor, whereby the row of imbricated copies carries out a certain dive in the transition area. In this dive the copies will be freely carried and be moving downwardly, whereby the friction between them will be reduced in the critical transfer area. This will contribute to ensuring that small differences in the friction between the products will not give rise to noticeable mutual displacements between the products when these are caused to be projected by the action of the acceleration belt.

3) Above the acceleration conveyer there is mounted a rotary roller having projecting fingers or ribs which, by a synchronized movement, can operate to press down the front edge area of the successively advanced products, down against the acceleration conveyer. Hereby it is possible to work with quite well defined moments of this conveyer effectively taking over the control of the product conveyance. Inasfar as the products may vary in thickness, the relevant receiver area of the conveyer should be resiliently supported, such that the pressing down may take place with a well adapted force irrespectively of the thickness of the row of products.

BRIEF DESCRIPTION OF THE DRAWING

In the following, the invention is described in more detail with reference to the drawing, which shows a side view of a transfer system according to the invention.

DETAILED DESCRIPTION OF A PREFERRED EMBODIMENT

A row of printed products in imbricated formation, e.g. newspapers 2, is delivered to a first conveyer 4 having an upper effective run, which is length variable in that a delivery roller 6 may be moved horizontally for adjustment of the system. This conveyer is driven by a motor 8 in synchronism with the feeding belt.

After the conveyer 4 another conveyer 10 receives the row of newspapers at a somewhat lower level, such that the paper row is moved in a non-supported dive over a certain distance. The latter conveyer accelerates the papers and delivers them successively to grippers 12 on a gripping chain 14, which, together with the conveyer 10, is driven by a motor 16. The two parts should be driven in synchronism, with the chain 14 slightly slower than the conveyer 10. The newspapers are delivered to the chain being projected over an outlet roller 18, whereby their folded front edges are projected into the grippers 12, which are automatically closed so as to take over the conveying of the papers. A good gripping engagement is ensured by virtue of the papers being advanced with a higher speed than the grippers, such that the paper front edges may reach the bottom of the grippers before these are closed. This is important both for the gripping security and for the order with which the papers are delivered from the chain conveyor.

However, for such a transfer of the products to be safe, it is a condition that the products be guided such that their front edges are located in a precise manner for engaging with the gripper. To a certain extent this is achievable by controlling the phase of the gripping chain relative to the arrival of the product front ends, but this is not fully safe because there may be irregularities both in the supplied product row and in the uniformity of the acceleration of the products on the conveyor 10; this acceleration is counteracted by the products initially sliding on the conveyor 10 and by the products being held back by the overlying products in the imbricated row.

A superior control may be provided for by means of a sensor 20 detecting the passage of the product front edges on the first conveyor 4 and causing the motor 16 to be adjusted until a correct engagement is ensured.

The dive of the product row between the two conveyors 4 and 10 results in the friction between the products in the very transfer area being reduced, whereby variations in the product friction will be of reduced influence on the accuracy of the transfer.

According to the invention, however, it is both desirable and possible to further improve the safety, viz. in anchoring the products to the conveyor 4 so long as they are still resting thereon and/or bringing the products to engage the conveyor 10 with increased friction as soon as the products have left the conveyor 4. Thereby it is avoided that the transfer accuracy is influenced by variations in the sliding friction between the overlapping products.

The anchoring of the products to the conveyer 4 is effected by means of a pressure roller 22, pressing down against the delivery roller 6, preferably by intermediate of a pressure belt 24, which will guide the product front edges safely under the roller 22. When the roller 22 or a corresponding row of interspaced short rollers is rotated with the same peripheral speed as the speed of the conveyer 4, the products 2 will be prevented from being drawn out from this engagement by the relatively weak pulling force exerted by the frictional engagement between conveyer 10 and the foremost portion of the products. Thus, the acceleration of the products cannot start until the moment where the rear end of the products leave the pressure engagement at the delivery rollers 6 and 22. For obvious reasons the roller 22 should be adapted to follow the roller 6 in the horizontal adjustment movements thereof.

The said strengthened frictional engagement between the products 2 and the conveyor 10 may be obtained by means of a roller 26 arranged above this conveyer and driven through a transmission 27 from the motor 16, the roller having protruding ribs or fingers 28, which, by the rotation of the roller, will successively press the front edge areas of the products 2 down against the acceleration belt 10. Beneath this pressure area the belt 10 is supported by a resilient element 30, such that the pressing down can be done with almost the same force, irrespectively of the thickness of the product row.

It is of a noticeable effect that between the rollers 22 and 26 there is a distance a, which corresponds to or is just slightly larger than the length of the products 2. This may be preadjusted by displacing the pair of rollers 6,22. If a tendency arises for a change of the passages of the front edges at the critical moments of time, the sensor 20 wall provide for such an adjustment of the motor 16 that the ribs or fingers 28 will again step correctly on to products, e.g. a couple of centimetres behind their front edges. Thereafter the products will automatically arrive at the grippers in a correct manner.

Preferably, the roller 26 is made of two mutually separated wheels which cooperate with the products near the opposed side edges thereof, i.e. in areas where there is no printing ink on the products. Also the free dive of the product row in the transition area contributes to avoiding smearing out of printing ink.

I claim:

1. A system for conveying flat products, comprising:

a first conveyor (4) for moving the products in imbricated formation, a second conveyor (14) having gripping members (12) thereon for gripping the products, a transfer conveyor (10) having a smooth surface for frictionally engaging products received from the first conveyor and successively delivering single ones of the products to the second conveyor by bringing the leading edges of the products into engagement with respective ones of the gripping members on the second conveyor as the products are moved past the delivery end of the transfer conveyor, sensor means (20) for detecting the leading edge of the products on the first conveyor, a speed adjustable driving unit (16) responsive to the sensor means for driving the transfer conveyor at a speed causing the arrival of the leading edges of the products at the second conveyor to coincide with the passage of the gripping members.

2. A system according to claim 1, in which the delivery end of the first conveyor (4) is at a higher level than the receiving end of the transfer conveyor (10).

3. A system according to claim 1, further comprising means for adjusting the length of the delivery end portion of the first conveyor (4).

4. A system according to claim 1, in which the driving unit drives the transfer conveyor at a higher speed than the speeds of the first and second conveyors, accelerating the products so as to effect expansion of the imbricated product flow and project the leading edges of the products into the gripping members, said system further comprising pressure roller means (22) above the delivery end of the first conveyor for preventing acceleration of the products until the rear ends of the products have passed the pressure roller means.

5. A system according to claim 4, further comprising pressing means (26, 28) above the transfer conveyor, for pressing the leading edge portion of products against the transfer conveyor to rapidly effect acceleration of the product, and wherein the transfer conveyor includes a resiliently depressible portion transfer conveyor beneath the pressing means.

* * * * *